United States Patent [19]

Muller

[11] Patent Number: 4,895,372

[45] Date of Patent: Jan. 23, 1990

[54] GOLF TRAINING DEVICE

[76] Inventor: Charles J. Muller, 549 Old Bridge Rd., Northport, N.Y. 11768

[21] Appl. No.: 330,771

[22] Filed: Mar. 30, 1989

[51] Int. Cl.[4] ..... A63B 69/36

[52] U.S. Cl. ..... 273/183 B; 273/188 R; 273/190 R; 273/195 R; 273/183 E

[58] Field of Search ..... 273/183 B, 183 E, 195 R, 273/195 B, 188 R, 188 A, 189 R, 189 A, 190 R, 190 A, 190 B, 190 C

[56] References Cited

U.S. PATENT DOCUMENTS 3,473,811 10/1969 Lees ..... 273/195 R
4,659,084 4/1987 Vuick ..... 273/183 B

FOREIGN PATENT DOCUMENTS 2118049 10/1983 United Kingdom ..... 273/183 E

*Primary Examiner*—George J. Marlo
*Attorney, Agent, or Firm*—Cooper & Dunham

[57] ABSTRACT

Portable golf training device for teaching proper golf swing having a ball platform with viewing means, a foot platform with right knee brace, left knee guide, left thigh target and right hip guide with sounding device, to ensure proper hip rotation and weight shift. The device teaches more elements of a golf swing, provides more feedback, and utilizes less rigid guiding equipment to decrease dependence on guides than known training devices.

The device, which can be utilized by a user as a self teaching device, or by an instructor as a teaching tool, comprises adjustable components which enable a user or golf instructor to determine proper adjustments and to adapt the device to a particular user or student.

9 Claims, 3 Drawing Sheets

GOLF TRAINING DEVICE

BACKGROUND OF THE INVENTION

The present invention relates to a portable device for assisting in teaching a proper golf swing.

An ideal golf swing comprises five important elements: proper alignment of the body, a shifting of weight to the right foot in the backswing, maintaining a still head with eyes fixed upon the ball, a shifting of weight to the left foot at the start of the downswing, and clearance of hips to the left prior to impact. These five elements, when practiced together, enhance the effectiveness of a user's golf swing much more than when one or several of the elements are omitted.

Golf training devices are known to assist in improving the swing. Prior art devices in this field address one or several of the above elements, or address different elements. Prior art devices most commonly have operated by teaching a limited number of elements, with the expectation that improvement of other elements not addressed by a particular device will follow. For example, U.S. Pat. No. 3,740,051 to Cross trains a user to adopt and maintain a proper head position during execution of a golf swing. Although a golfer may have perfected his or her swing, and only seeks help with positioning his or her head, because the apparatus addresses only the head, the integrity of the other elements of the swing may be adversely affected.

A golfer who trains on only one element is likely to master that one element to the detriment of others. As a consequence of the limited utility of the prior art devices, a golfer who wishes to improve his or her performance on all desired elements must train on several different machines, all addressed to one or two elements.

Some prior art devices which comprise rigid guides do not accurately simulate playing conditions, where no guides are present. For example, Lopez U.S. Pat. No. 4,688,800 describes a device to be worn around a golfer's waist. A golfer who does not swing a golf club correctly, while wearing the device, will abruptly hit the golf swing guide with his or her elbow and will not be able to complete the swing without severe interference from the guide with his or her elbow. U.S. Pat. No. 3,623,733 to Cavanaugh shows a body "cage" which will touch the golfer's body if he or she unduly sways while taking a swing. The device also comprises a trough-type track from which the ball is hit. If hit improperly, the golfer's club strikes the walls of the trough. A golfer may become dependent on such aids and be unable to perform well in their absence.

U.S. Pat. No. 4,583,738 to Fava discloses a device comprising a guide rail for directing the movement of a golf club in a predetermined swing plane. The device emits a rhythmic tone which corresponds to the movement of the golf club. A golfer that utilizes that device may become dependent on the guide rail and audio signal and be unable to duplicate a proper swing on the golf course.

Further, the training devices of the prior art offer no feedback other than interference by a part of the device during an improper swing. The user is left to guess what he or she did improperly, and attempt to correct it. There is no way to quantify the amount of error.

For example, U.S. Pat. No. 3,138,388 to Herold shows a device which coordinates shoulder and hip movement during a downswing. The ratchet-operated device comprises bars which rest on the golfer's shoulders and buttocks. When, during a downswing, the golfer's shoulders improperly pivot before the hips, the bar resting on the shoulders locks, warning of the impending improper swing. The golfer has no way of knowing exactly what he or she did incorrectly, and as a result, has no way of knowing exactly what to adjust in order to perfect the swing. Operating the device properly, such that the shoulder rest does not lock, is a process of trial and error.

U.S. Pat. No. 3,510,135 to Gentile discloses a means for developing correct positioning only of the head and feet of a golfer, comprising foot markings and a padded knob which rests against the head. The device addresses only these isolated body parts and provides a rough guide, rather than feedback means, for a proper swing.

SUMMARY OF THE INVENTION

It is an object of the present invention to provide a portable golf training device which teaches a complete, proper golf swing comprising proper alignment of the body, shifting of body weight to the right foot when beginning a back swing, maintaining a still head with eyes fixed upon the ball throughout the swing, a shifting of body weight to the left foot at the start of a downswing, and clearance of hips to the left prior to impact.

It is another object of the invention to provide a device to assist in teaching a proper golf swing without reliance on rigid guides which are not present on the golf course.

It is still another object of the present invention to provide a golf training device which provides a golfer with feedback of his or her progress.

The present invention is an improvement on the prior art and discloses a novel golf training device which teaches all five of the elements incorporated by professional golfers in execution of a golf swing.

A movable hip guide which comprises movable measurement means to measure right hip movement, an adjustable sighting device, a stationary right knee stop, a left thigh target, and a movable left knee post work together to teach a user proper alignment of the body, proper shifting of body weight during a backswing, maintenance of a still head throughout the swing, proper body weight shifting during a downswing, and clearance of hips to the left prior to impact.

The stops, targets and guides of the device do not force a proper swing, thus creating dependence on them. Rather, they define the outer limits of correct alignment and movement so that a student may memorize the feel of proper body alignment and movement while being left to align and move the body on his or her own, without merely fitting into a guide.

DETAILED DESCRIPTION OF THE INVENTION

Figure 1:
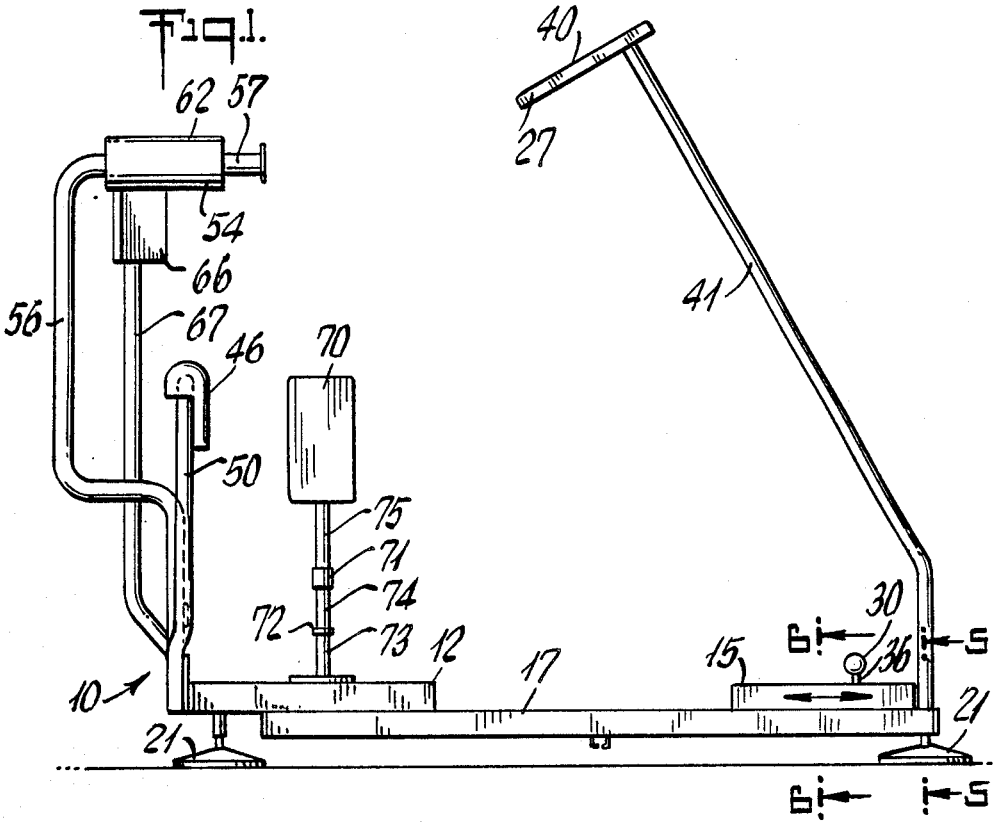
FIG. 1 is a side elevational view of a golf training device in accordance with the present invention.

Generally, as shown in FIG. 1 of the drawings, the present invention relates to golf training device 10. The device 10 comprises a foot platform 12 and a ball platform 15 attached by center rail 17. Foot platform 12 and ball platform 15 are made of aluminum and in a preferred embodiment are covered with artificial turf.

Figure 6:
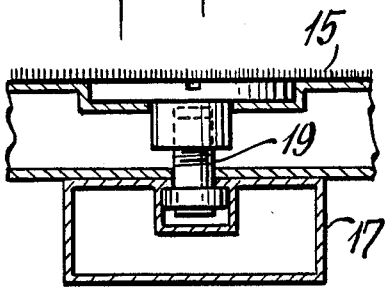
FIG. 6 is a partial cross-sectional view taken along the line 6—6 in FIGS. 1 and 2.
Figure 7:
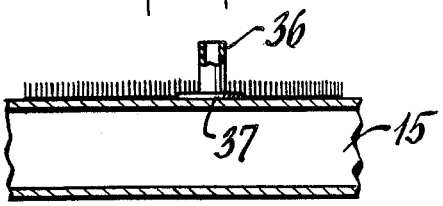
FIG. 7 is a partial cross-sectional view taken along the line 7—7 in FIG. 2.

Center rail 17 connects foot platform 12 and ball platform 15. Center rail 17 is affixed by fasteners 18 to the underside of foot platform 12. As best seen in FIG. 6, center rail 17 is movably attached by fastener 19 to the underside of ball platform 15. Ball platform 15 can be rotated 90° about fastener 19 so that the platform can be positioned with respect to center rail 17. Ball platform 15 also can be moved along center rail 17, which is calibrated, so that ball platform 15 can be adjusted both away from or closer to foot platform 12. When ball platform 15 is at a desired position, it can again be rotated 90° about fastener 19 to be locked into position. As best seen in FIG. 7, tee 36 is attached to ball platform 15 by fastener 37.

One foot 21 is attached to the center of the front edge of ball platform 15. Two other feet 21 are attached to the rear corners of foot platform 12. Thus, the two platforms are supported by three legs. Foot platform 12 is large enough to support most of the components of the device, as well as the user.

Figure 2:
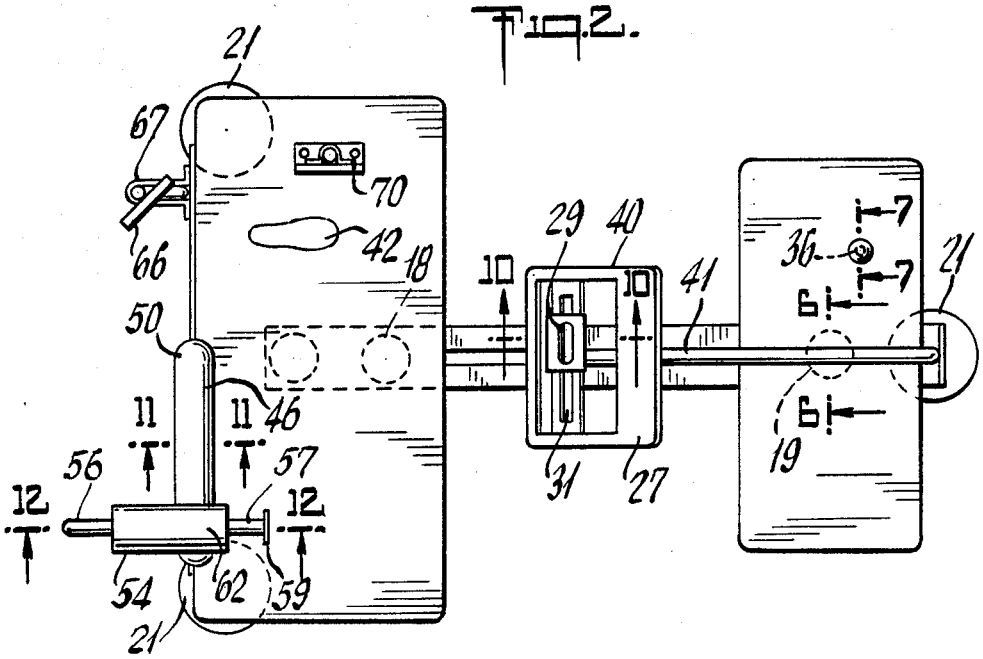
FIG. 2 is a top plan view of the golf training device in accordance with the present invention.
Figure 5:
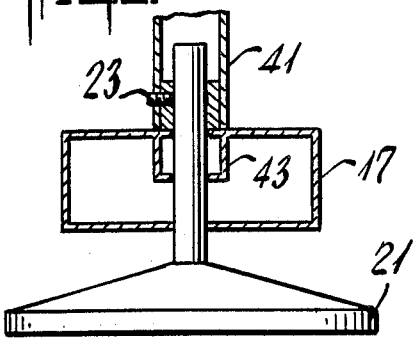
FIG. 5 is a partial cross-sectional view taken along the line 5—5 in FIG. 1.
Figure 10:
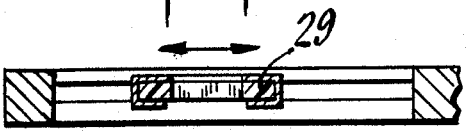
FIG. 10 is a partial cross-sectional view taken along the line 10—10 in FIG. 2.

Connected near one end of center rail 17, forward of ball platform 15, is sighting device 40. Sighting device 40 extends from support pole 41, which at its lowermost end is seated into channel 43 which runs through the center of center rail 17. As best seen in FIG. 5, pole 41 of sighting device 40 can be moved along channel 43 to cause sighting device 40 to be closer to or further from foot platform 12, depending upon the size of the user. Support pole 41 is connected by fasteners 18 at its uppermost end to head guide 27. Support pole 41 is bent at its lower end at an angle of between 90° and 180° for proper location of head guide 27. Head guide 27 has a viewing port 29 through which a user may view a golf ball 30 placed on tee 36. As shown in FIG. 2, viewing port 29 slides laterally along track 31 and can be adjusted for ease of use and desired body position with respect to the position of foot platform 12. As best seen in FIG. 10, viewing port 29 also slides laterally within head guide 27 to further allow for adjustment with respect to the height of the user.

Most of the guides and stops of the golf training device 10 are located on foot platform 12. As seen in FIG. 2, foot platform 12 has foot guide 42 drawn on it in a contrasting color to aid the user in properly positioning his or her left foot. Two foot guides may be used instead of a single guide.

Figure 11:
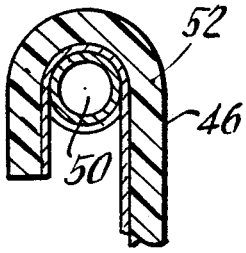
FIG. 11 is a partial cross-sectional view taken along the line 11—11 in FIG. 2.

As seen in FIGS. 1–4, mounted by bracket means to foot platform 12 is right knee brace or stop 46, comprising a U-shaped bar 50. As seen in FIG. 11, in a preferred embodiment, U-shaped bar 50 is covered with cushioned plastic sleeve 52. Knee brace 46 prevents the right knee from straightening during the backswing. A straight leg causes loss of power.

Figure 8:
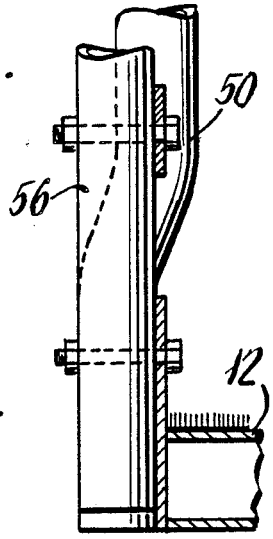
FIG. 8 is a partial cross-sectional view taken along the line 8—8 in FIG. 4.
Figure 12:
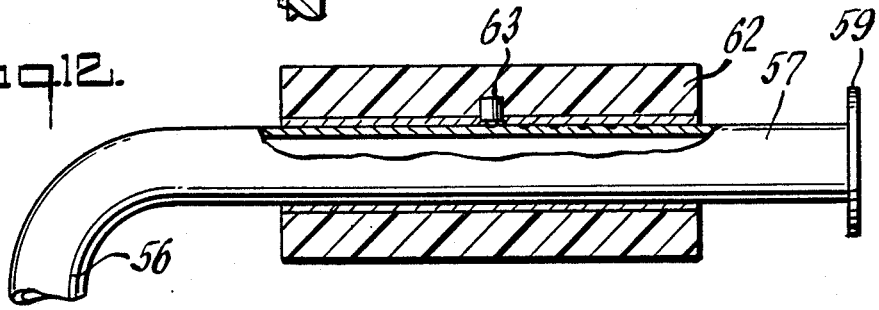
FIG. 12 is a partial cross-sectional view taken along the line 12—12 in FIG. 2.

As best seen in FIGS. 1, 2 and 8 right hip guide 54 is mounted on foot platform 12 behind and above right knee brace 46. Hip guide 54 comprises a shaft 56, the top portion 57 of which is at a right angle to the bottom portion, and parallel to foot platform 12. As seen in FIG. 12, movable cushioned plastic sleeve 62 surrounds the top portion 57 of shaft 56, and stop 59 prevents sleeve 62 from disengaging from top portion 57. Movable sleeve 62 is adapted to move freely on top portion 57 and to produce an audible "click" through clicker 63 to signal proper movement of the right hip during the body swing. Movable sleeve 62 returns to the front end of top portion 57 by spring means (not shown) when a user's hip is not in contact with movable sleeve 62.

Figure 3:
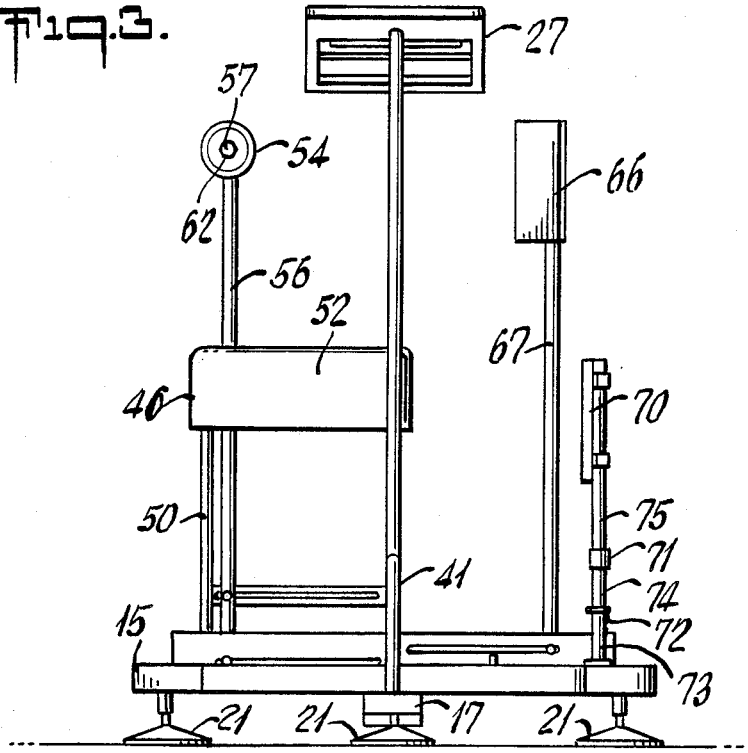
FIG. 3 is a front elevational view of the golf training device in accordance with the present invention.
Figure 4:
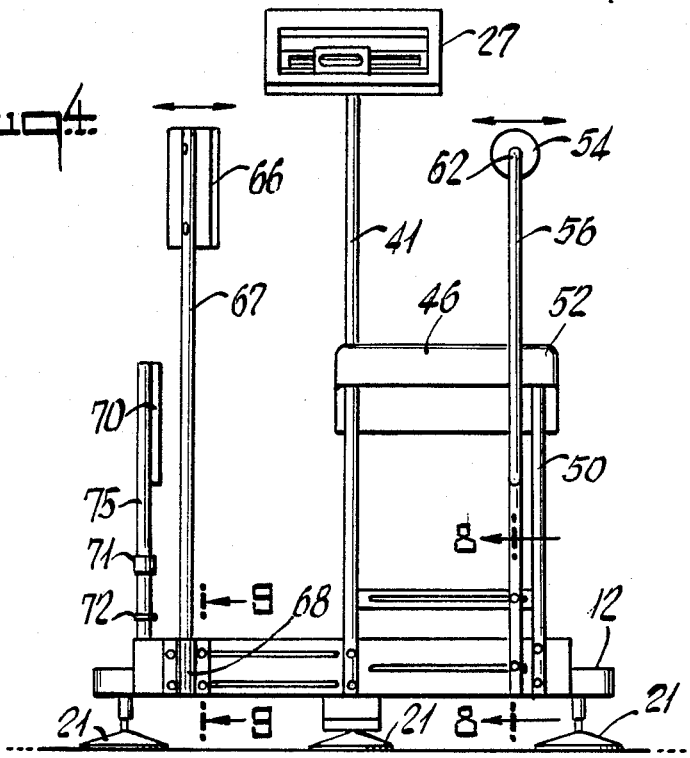
FIG. 4 is a rear elevational view of the golf training device in accordance with the present invention.
Figure 9:
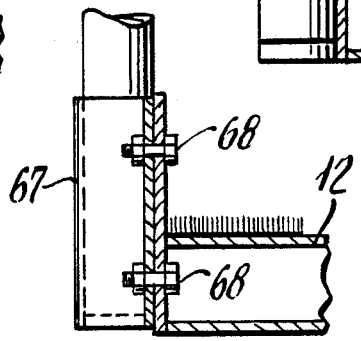
FIG. 9 is a partial cross-sectional view taken along the line 9—9 in FIG. 4.

As seen in FIGS. 3 and 4, left thigh target 66 is located opposite hip guide 54. As seen in FIG. 9, pole 67 supporting left thigh target 66 is fixed by bracket means 68 to the rear of foot platform 12. Left thigh target 66 prevents the left thigh from traveling too far upon completion of the swing and indicates the proper left thigh finishing position.

As best seen in FIGS. 1 and 3, hinged left knee guide 70 is also affixed to foot platform 12 next to foot guide 42. Hinged left knee guide 70 comprises three coincident posts 73, 74, 75. The lower two posts 73, 74 are connected by magnetic latch 72. The top two posts 74, 75 are attached by hinge means 71 to form a pivot. Hinge means 71 enables the left knee guide 70 to bend upon contact with the user's left knee. If the user's left knee pushes the top of knee guide 70 beyond a predetermined range, magnetic latch 72 will release, causing the upper portion of left knee guide 70 to fall over.

In use of the golf training device 10, a user places his or her left foot onto foot guide 42. The user distributes weight evenly among both feet and rests the right hip against right hip guide 54 which has previously been adjusted for the user's body size. The knees are bent slightly. The user places the head of his or her golf club next to golf ball 30 on tee 36 and views golf ball 30 through viewing port 29, which also has been adjusted for the user's body size and club selection. The head is then turned approximately two inches to the right. When these steps have been followed, the user will have achieved proper initial alignment of the body.

The user then turns the hips right, sliding sleeve 62 along the top portion 57 of right hip guide 54, until his or her club is raised and the backswing is completed. A proper swing will cause movable sleeve 62 to emit an audible "click", indicating that weight has shifted to the right foot and a sufficient hip turn is achieved. A swing which is insufficient will not move sleeve 62.

The user must keep the golf ball 30 in view through viewing port 29 throughout the back swing. Concurrently with the backswing, most of the user's weight should be shifted to the right heel. Throughout the backswing, the right leg is slightly bent over right knee brace 46.

After the backswing is completed and the right knee is bent over right knee brace 46, ball 30 is still viewed through viewing port 29, and the golfer begins to shift weight to the left foot to start the downswing.

During the downswing, the hips are turned left to avoid knocking over hinged left knee guide 70 during the downswing.

The user focuses upon the ball 30 through viewing port 29 during the backswing, during the downswing, and until after impact, catching a glimpse of the empty tee 36 through viewing port 29 after impact, thus maintaining a still head throughout his or her entire swing.

In a properly executed complete swing, the swing is finished with the user's left thigh touching left thigh target 66 and missing left knee guide 70, thus insuring that the hips clear left prior to impact and weight has completely shifted to the left foot. If the user follows the proper procedure assisted by the golf training device 10, the golf ball should travel along the correct trajectory.

Although not shown, an optional sound making device could be attached to a user's belt to assist in keeping the right elbow tucked in during the swing.

Although the invention has been shown and described for a right-handed user, the elements could be reversed for a left-handed user. The device shown is appropriate for a standard driver. It could readily be adapted for other clubs.

It should be apparent to those skilled in the art that other modifications could be made in the device without departing from the spirit and scope of the invention.

I claim:

1. A golf-training device for use in training a user to hit a golf ball along a predetermined trajectory, comprising:

a. a foot platform connected to one end of a center rail and upon which the user stands;

b. a ball platform movably connected to the opposite end of said center rail and upon which the ball is placed;

c. a sighting device movably connected to and projecting upwardly from said center rail or said ball platform;

d. a right knee brace connected to and projecting upwardly from said foot platform;

e. a right hip guide movably connected to said foot platform;

f. a left thigh target connected to and projecting upwardly from said foot platform; and g. a left knee guide movably connected to said foot platform in front of said left thigh target, whereby during the course of a swing, the user's head is trained to remain still by said sighting device, the right knee is prevented from straightening by said right knee brace, the right hip is trained to travel a correct distance during a back swing by said right hip guide and to remain on a constant plane which is perpendicular to the golf ball trajectory, the left thigh is trained to travel the correct distance during the down swing by said left thigh target and the left knee is trained to slide at a proper angle to the golf ball trajectory by said left knee guide.

2. A golf training device as in claim 1, further comprising means for moving said ball platform and said foot platform toward or away from each other, whereby the device is adapted to be adjusted based on the size of the user.

3. A golf training device as in claim 1, wherein said sighting device further comprises a sighting port through which the user sights the golf ball placed on said ball platform on a golf tee.

4. A golf training device as in claim 3, further comprising means for moving said sighting device such that the golf ball is always visible through said sighting port during use.

5. A golf training device as in claim 1, further comprising means for moving said sighting device toward or away from said foot platform, whereby the device is adapted to be adjusted based on the size of the user.

6. A golf training device as in claim 1, wherein said right hip guide further comprises a post connected at one end to said foot platform and having a top portion parallel to said foot platform.

7. A golf training device as in claim 6, wherein said top portion of said right hip guide includes a sleeve adapted to slide freely over said top portion when contacted by the user and means for emitting an audible sound when said sleeve reaches the proper position on said top portion.

8. A golf training device as in claim 1, wherein said left knee guide further comprises three coincident posts adapted so as to permit said guide to disengage from said foot platform upon contact by the user.

9. A golf training device as in claim 1, wherein said foot platform further comprises means indicating proper foot placement by the user.

* * * * *